US008591071B2

(12) United States Patent
Hochstein

(10) Patent No.: US 8,591,071 B2
(45) Date of Patent: Nov. 26, 2013

(54) L.E.D. LIGHT EMITTING ASSEMBLY WITH SPRING COMPRESSED FINS

(75) Inventor: Peter A. Hochstein, Troy, MI (US)

(73) Assignee: Relume Technologies, Inc., Oxford, MI (US)

( * ) Notice: Subject to any disclaimer, the term of this patent is extended or adjusted under 35 U.S.C. 154(b) by 115 days.

(21) Appl. No.: 13/389,497

(22) PCT Filed: Sep. 11, 2009

(86) PCT No.: PCT/US2009/056635

§ 371 (c)(1), (2), (4) Date: Feb. 8, 2012

(87) PCT Pub. No.: WO2011/031266

PCT Pub. Date: Mar. 17, 2011

(65) Prior Publication Data

US 2012/0147603 A1 Jun. 14, 2012

(51) Int. Cl.
*F21V 29/00* (2006.01)

(52) U.S. Cl.
USPC ..... 362/294; 362/249.02; 362/373

(58) Field of Classification Search
USPC ..... 362/545–547, 217.01, 218, 217.14, 362/240, 249.01, 249.02, 294, 373, 800
See application file for complete search history.

(56) References Cited

U.S. PATENT DOCUMENTS

| | | | | |
|---|---|---|---|---|
| 4,729,076 | A | 3/1988 | Masami | |
| 5,042,257 | A | 8/1991 | Kendrick | |
| 5,857,767 | A | 1/1999 | Hochstein | |
| 5,986,618 | A * | 11/1999 | Aakula et al. | 343/872 |
| 2008/0089071 | A1 * | 4/2008 | Wang | 362/294 |
| 2008/0298069 | A1 * | 12/2008 | Chu | 362/294 |
| 2009/0080187 | A1 | 3/2009 | Chou | |
| 2010/0073943 | A1 * | 3/2010 | Yeh et al. | 362/373 |

* cited by examiner

*Primary Examiner* — Hargobind S Sawhney
(74) *Attorney, Agent, or Firm* — Dickinson Wright PLLC

(57) ABSTRACT

A light emitting assembly includes an extruded heat sink (20) divided into a pair of elongated sections (64) with a plurality of light emitting diodes (88) disposed thereon. The elongated sections (64) present identical cross sections and are disposed in spaced and parallel relationship to mirror one another and define a fin space (68) therebetween. A plurality of fins (70) including bends (72) stamped therein are spring compressed between the elongated sections (64). The fins (70) include shoes (76) at fin ends to space the fins (70) from one another in the fin space (68). The fins (70) are retained in a fin channel (38) between a pair of ridges (28). A plurality of straps (82) extend across the fin space (68) to clamp the fins (70) between the elongated sections (64).

25 Claims, 5 Drawing Sheets

L.E.D. LIGHT EMITTING ASSEMBLY WITH SPRING COMPRESSED FINS

BACKGROUND OF THE INVENTION

1. Field of the Invention

The subject invention relates to a light emitting assembly of the type including light emitting diodes (L.E.D.s), and more particularly, to a heat sink for avoiding high temperatures causing early degradation of the L.E.D.s.

2. Description of the Prior Art

Light generating assemblies including light emitting diodes are more efficient than other light sources, such those including high intensity discharge (H.I.D.) lamps. At least a fifty percent (50%) energy savings is possible when light sources including H.I.D. lamps are replaced with properly designed L.E.D. light assemblies. An example of such an L.E.D. light assembly is disclosed in U.S. Pat. No. 5,857,767 to the present inventor, Peter A. Hochstein, which is directed to effective thermal management. The '767 patent discloses a plurality of light emitting diodes disposed on a heat sink. The heat sink includes a plurality of fins to increase the surface area of the heat sink and thus the amount of heat transferred from the light emitting diodes to surrounding ambient air. Such L.E.D. light assemblies have an expected life exceeding 10-12 years, compared to a nominal 2-3 year life of H.I.D. light sources. Thus, municipalities and other cost-conscious entities desire to retrofit their standard H.I.D. light assemblies with L.E.D. light assemblies. The energy-related cost savings allow the L.E.D. light assemblies to pay for themselves in about 4-5 years.

The continuously increasing power density of L.E.D. light assemblies creates a need for more effective thermal management. The prior art includes sophisticated heat sink designs to achieve the more effective thermal management. Such prior art heat sinks include a pair of elongated sections spaced and parallel to one another to define a fin space therebetween and a plurality of fins disposed in spaced relationship to one another and extending in width across the fin space between the elongated sections. However, due to manufacturing tolerances, at least one of the fins is often unintentionally formed longer in width than the other fins. The unequal widths can prevent some of the fins from totally engaging the two sections thereby impeding the transfer of heat from the elongated sections to the fins. One solution to this problem is disclosed in U.S. Pat. No. 5,042,257 to Kendrick et. al, wherein each of the fins are clamped by fins of the other elongated section.

The prior art provides a method of fabricating such a heat sink, including forming a strip of heat sink, dividing the strip of heat sink into at least two elongated sections, spacing each elongated section from and parallel to another one of the elongated sections to define a fin space therebetween, and disposing a plurality of fins in spaced relationship to one another and extending in width across the fin space between the elongated sections. However, due to manufacturing tolerances, the fins are of different widths whereby some of the shorter fins are not in total contact with the elongated sections.

SUMMARY OF THE INVENTION

The subject invention provides an L.E.D. light emitting assembly comprising such a heat sink supporting a plurality of light emitting diodes, and characterized by each of the fins including at least one bend rendering the fins spring compressible in width across the fin space for being spring compressed between the elongated sections of the heat sink.

The subject invention also provides for a method of fabricating an L.E.D. light emitting assembly comprising such a heat sink supporting a plurality of light emitting diodes, and characterized by forming at least one bend in each of the fins to render the fins compressible in the width across the fin space.

ADVANTAGES OF THE INVENTION

The bend in each of the fins allows the fin to be spring compressed between the elongated sections to assure that each fin is in contact with both elongated sections to provide maximum heat transfer from the elongated sections to both ends of the fins. Even if the fins are unintentionally formed of unequal width, for example if some of the fins are formed wider than others due to manufacturing tolerances, each of the fins can still be spring compressed between the elongated sections to assure requisite contact to maximize the maximum heat transfer. Thus, both ends of each of the fins transfers heat away from both elongated sections to ambient air to minimize temperature rise at the light emitting diodes and contribute to the improved thermal management of the L.E.D. light emitting assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
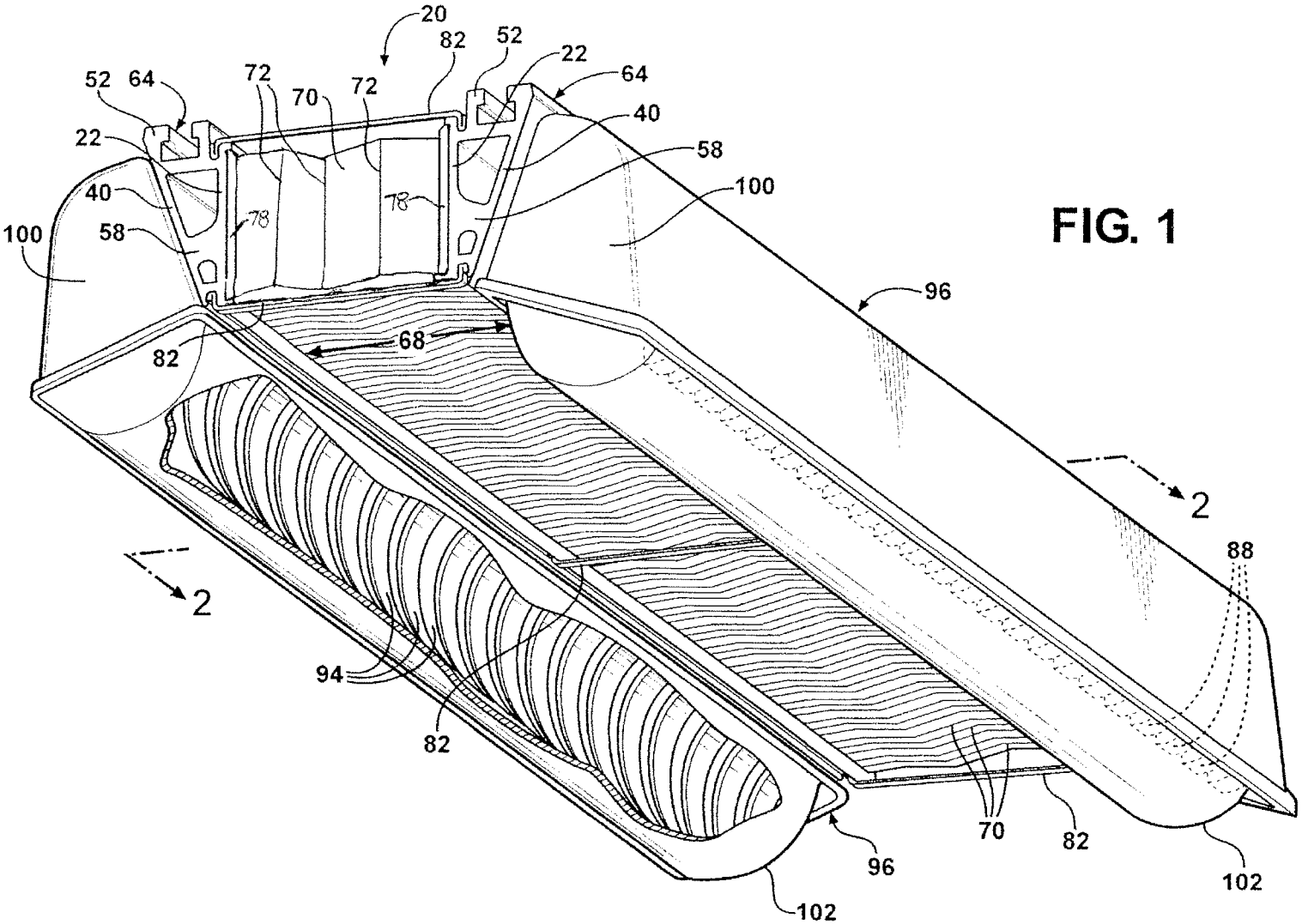
FIG. 1 is a perspective of a preferred embodiment of an L.E.D. light emitting assembly incorporating the heat sink of the subject invention.
Figure 2:
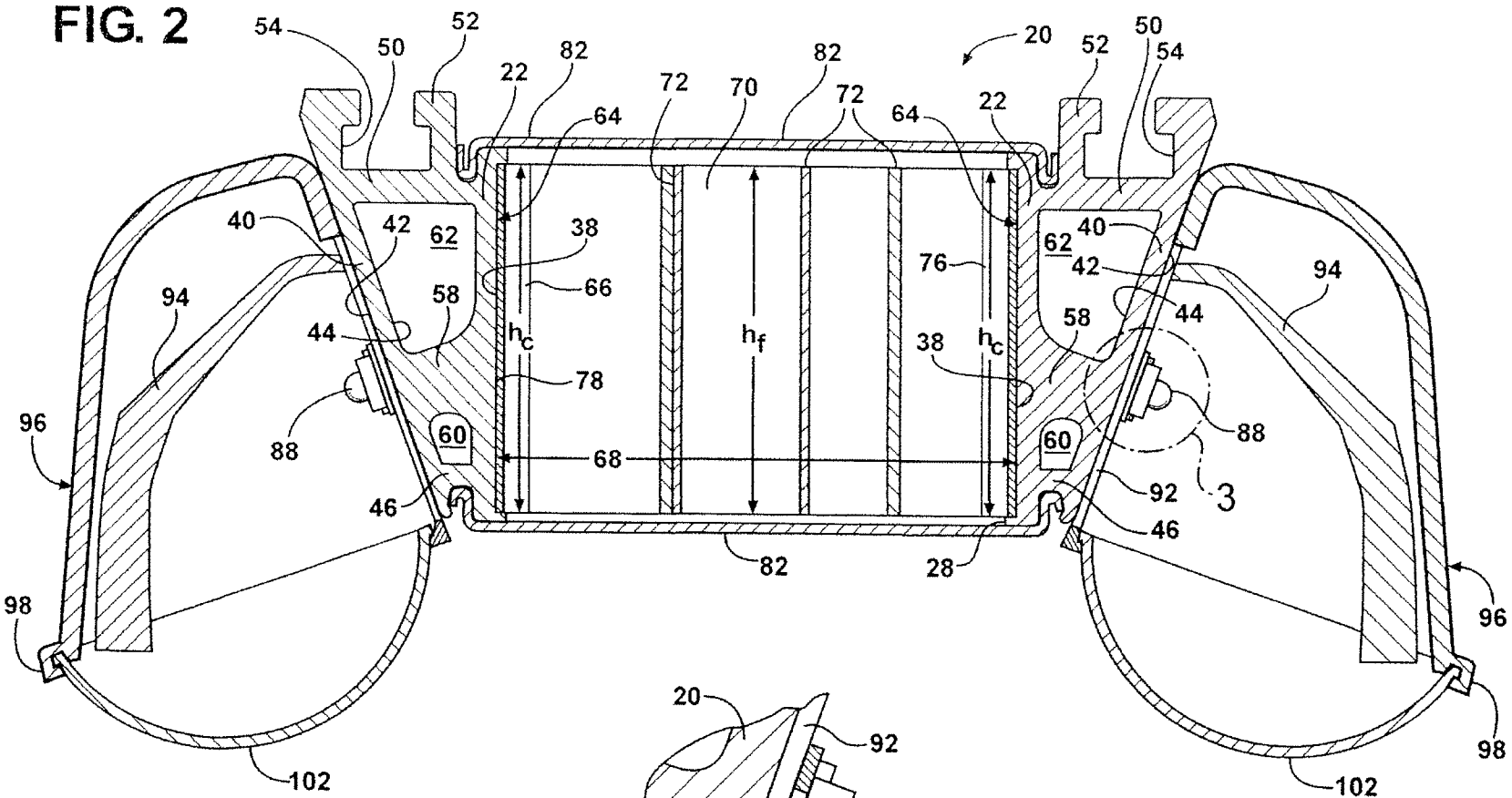
FIG. 2 is a cross sectional view taken along line 2-2 of FIG. 1.
Figure 4:
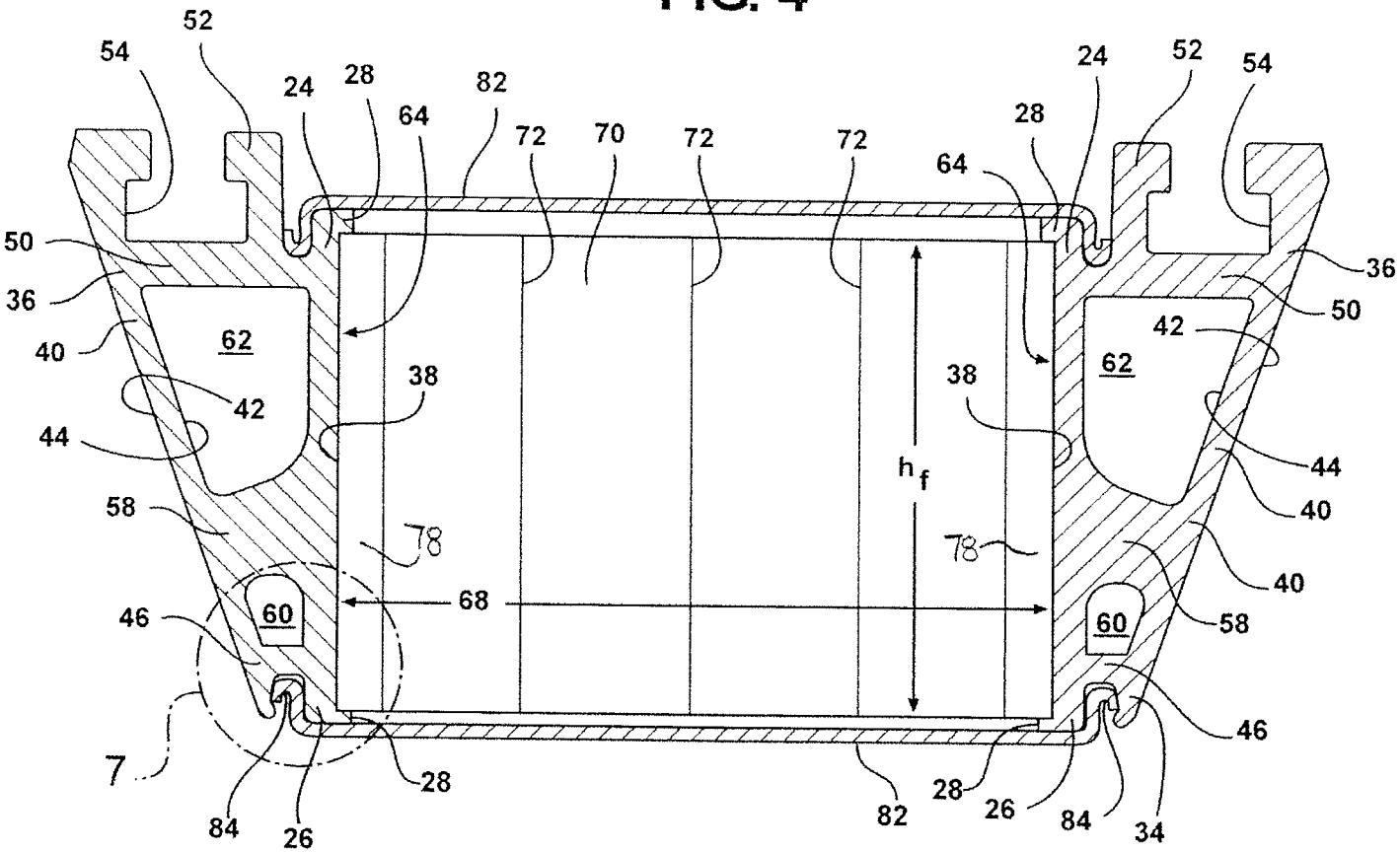
FIG. 4 is an enlarged cross sectional view of the elongated sections and straps but an end view of the first fin.
Figure 5:
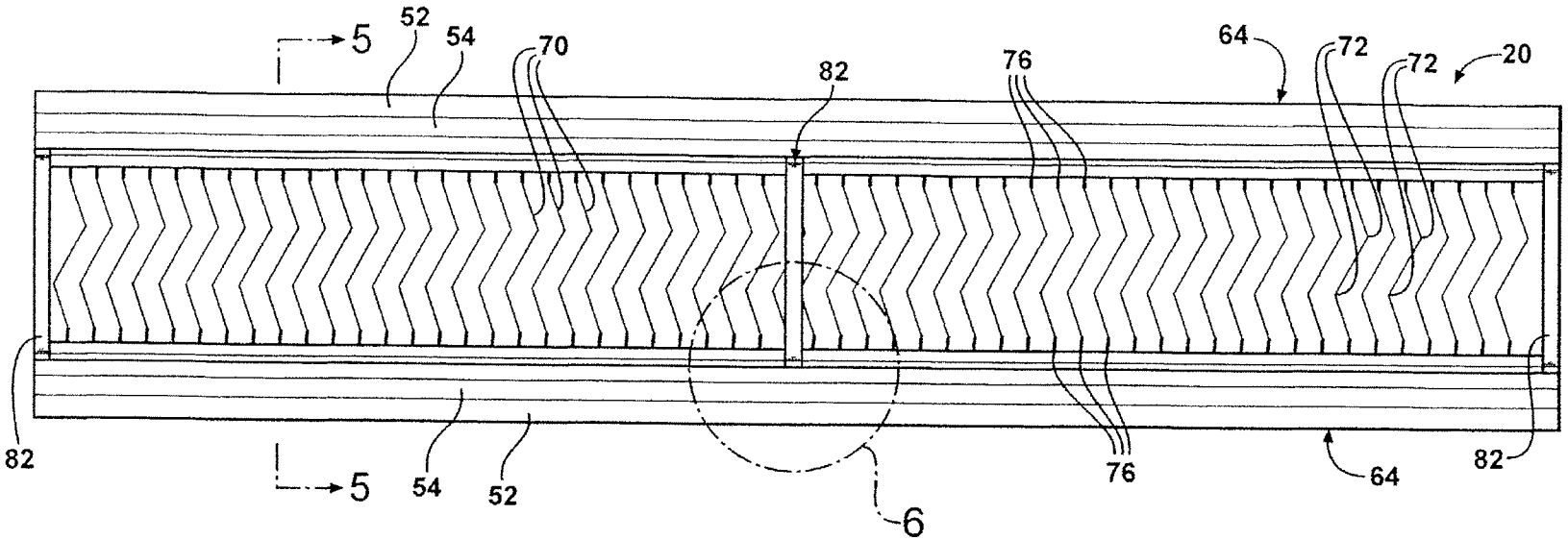
FIG. 5 is a top view of the heat sink shown in FIG. 4.
Figure 6:
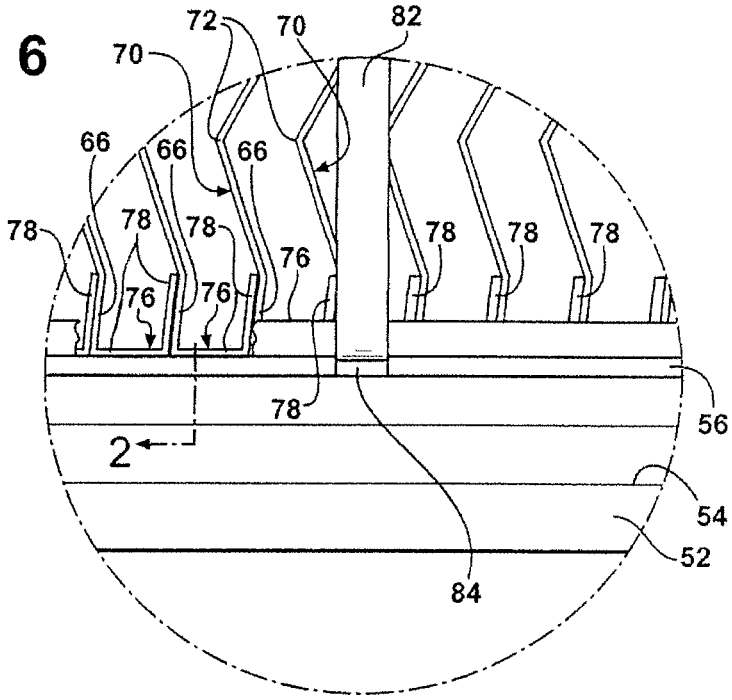
FIG. 6 is an enlarged fragmentary view showing the engagement between adjacent fins of FIG. 4.
Figure 7:
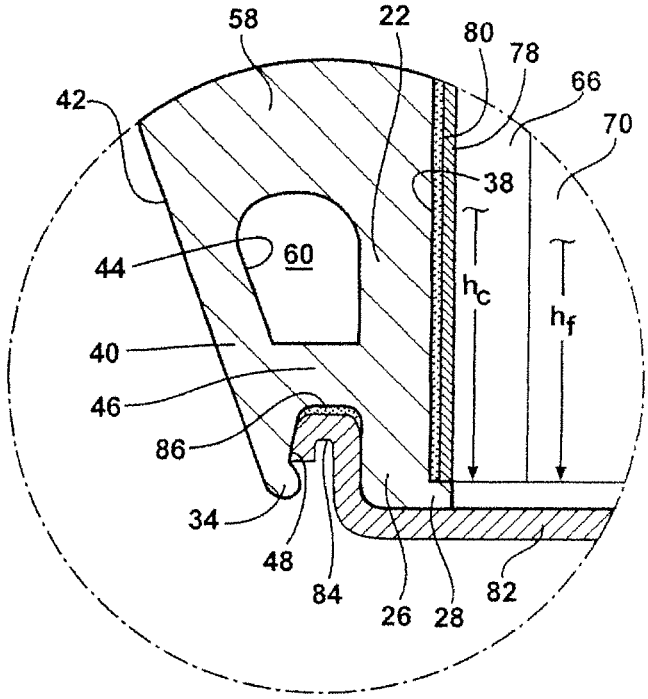
FIG. 7 is an enlarged fragmentary view showing a catch wedged in a strap slot of one of the elongated sections of FIG. 4.

Referring to the Figures, an L.E.D. light emitting assembly is shown in FIGS. 1 and 2 with only a heat sink 20 thereof shown in FIGS. 4-7. The heat sink 20, generally indicated, is formed of thermally conductive aluminum material, such as homogeneous aluminum or an aluminum alloy. The heat sink 20 is typically formed by extruding a continuous strip of the material having a cross section presenting a fin wall 22 having an upper side edge 24 and a lower side edge 26. The fin wall 22 includes a fin retaining ridge 28 extending transversely from each of the side edges 24, 26 to present a fin channel 38 having a channel height $h_c$ therebetween, as shown in FIGS. 2, 4, and 7.

The description proceeds on reference to the cross section of the heat sink. An LED wall 40 is spaced from the fin wall 22 and extends outwardly and upwardly from a bottom side edge 34 to a top side edge 36, as shown in FIGS. 1, 2, and 4. The bottom side edge 34 of the LED wall 40 is spaced from the lower side edge 26 of the fin wall 22, and the top side edge 36 of the LED wall 40 is spaced a greater distance from the upper side edge 24 of the fin wall 22 than the bottom side edge 34 is from the fin wall 22, so that the LED wall 40 is canted upwardly and outwardly relative to the fin wall 22. The LED wall 40 also presents a mounting surface 42 facing outwardly, i.e., away from the fin wall 22, and a heat transfer surface 44 facing inwardly, i.e. toward the fin wall 22.

The heat sink 20 includes a lower truss member 46 connecting the fin wall 22 to the heat transfer surface 44 of the LED wall 40 above the lower side edge 26 to space the heat transfer surface 44 from the fin wall 22. The lower truss member 46 defines a lower strap slot 48, as best shown in FIG. 7. The heat sink 20 includes an upper truss member 50 connecting the fin wall 22 to the heat transfer surface 44 below the upper side edge 24. The upper truss member 50 spaces the heat transfer surface 44 further from the fin wall 22 than does the lower truss member 46.

The heat sink 20 includes an attachment block 52 extending along the upper truss member 50 and spaced from the upper side edge 24 of the fin wall 22 to define an upper strap slot 56 therebetween. The attachment block 52 includes an attachment slot 54 extending into the attachment block 52. A mounting screw, bolt, bracket, or other attachment member can be disposed in the attachment slot 54 to mount the assembly to a support. The attachment slot 54 is typically C-shaped, as shown in FIGS. 1, 2, and 5, but can include other shapes.

A heat transfer web 58 connects the fin wall 22 and the heat transfer surface 44 of the LED wall 40, in the space between the truss members 46, 50. The heat transfer web 58 defines a lower tubular space 60 between the heat transfer web 58 and the upper truss member 50 and an upper tubular space 62 between the heat transfer web 58 and the upper truss member 50. The upper tubular space 62 has a greater cross sectional area than a cross sectional area of the lower tubular space 60. As alluded to above, the heat sink 20 is typically formed by extrusion, but can be formed by casting or the like.

The heat sink 20 is divided into at least two independent elongated sections 64 each having an identical cross section, as described above. The fin wall 22, ridges 28, LED wall 40, truss members 46, 50, heat transfer web 58, tubular spaces 60, 62, strap slots 48, 56, attachment block 52, and attachment slot 54 extend continuously along each elongated section 64, as shown in FIG. 1. However, the elongated sections 64 of the heat sink 20 can be formed without the fin wall 22, LED wall 40, truss members 46, 50, or attachment block 52. Also, the elongated section 64 can be formed to present cross sections different from that described above and different from one another. For example, each elongated section 64 can include only a single rectangular strip of homogeneous aluminum material.

Each elongated section 64 is disposed in spaced an parallel relationship to another one of the elongated sections 64 to define a fin space 68 therebetween. The fin wall 22 of each elongated section 64 faces parallel to the fin wall 22 of the other elongated section 64. The LED wall 40 of each elongated sections 64 is canted relative to the LED wall 40 of the other elongated section 64 and faces away and diverges upwardly and outwardly from the LED wall 40 of the other elongated section 64, as shown in FIGS. 1, 2, and 4. Each pair of elongated sections 64 therefore mirror one another.

The light emitting assembly also includes a plurality of fins 70 disposed in parallel and spaced relationship to one another and extending in width across the fin space 68 between the fin walls 22 of the elongated sections 64. Each of the fins 70 include at least one bend 72 formed therein to render the fins 70 compressible in the width across the fin space 68, also shown in FIGS. 1 and 4. The bend 72 allows the fins 70 to be spring compressed between the elongated sections 64. The bend 72 can include a plurality of corrugations having pointed apexes, as shown in FIGS. 1 and 5. Instead of the pointed apexes defining the bends 72 in each of the fins 70, the bends 72 can include a single corrugation, a single curve, a plurality of curves, or another irregularity to allow compression between the elongated sections 64.

The fins 70 are formed by first forming a continuous sheet of aluminum material, typically by rolling, extrusion, casting, or the like. The sheet is then stamped to form a plurality of the bends 72 therein. Next, the continuous sheet is cut into a plurality of sheet strips. Each sheet strip has a fin height $h_f$ being slightly less than the channel height $h_c$ and the plurality of bends 72 extending along the fin height $h_f$. Each sheet strip including the bends 72 is cut into a plurality of the fins 70 extending between fin ends. Each fin 70 has the fin height $h_f$ and includes at least one of the bends 72 extending along the fin height $h_f$. The fins 70 are also formed to include a shoe 76 at each of the fin ends. Each of the shoes 76 include a flange 78 extending inwardly toward one another so that each of the shoes 76 present an L-shaped cross section, as best shown in FIG. 6. The shoes 76 are typically formed by stamping, but can be formed by another method.

The method of fabricating the L.E.D. light assembly includes slidably disposing the shoes 76 of the fins 70 along the fin channels 38 between the fin retaining ridges 28 of the pair of elongated sections 64 so that the fins 70 are disposed between the elongated sections 64 and extend across the fin space 68. Next, the method includes engaging each of the inwardly extending flanges 78 of the fins 70 with the adjacent fin 70 to space the fins 70 along the fin channel 38. Each of the fins 70 includes a shoe engagement section 66 at each fin end 74 for parallel engagement with the flanges 78 of the adjacent fin 70, as best shown in FIG. 6. The flanges 78 are disposed in abutting relationship with the adjacent fin 70 to define an air path between the adjacent fins 70 for heat transfer with the fins 70. The elongated sections 64 are then moved toward one another to spring compress each of the fins 70 between the fin channels 38 of the fin walls 22 of the elongated sections 64. A first adhesive 80 is disposed over the fin walls 22 of the elongated sections 64, as shown in FIG. 7, before engaging the fins 70 and the fin walls 22 for adhering the elongated sections 64 to the fins 70. However, the fins 70 can be maintained between the fin walls 22 of the elongated sections 64 without the first adhesive 80.

The light emitting assembly also includes a plurality of straps 82 extending across the fin space 68 between the elongated sections 64 to clamp the fins 70 between the elongated sections 64. The straps 82 are typically formed of a high strength metal, such as stainless steel, and include U-shaped catches 84 at the ends thereof. Alternatively, the catches 84 of the straps 82 can also include another shape instead of the U-shape. The straps 82 extend across the fin space 68 between and over the lower side edges 26 of the spaced fin walls 22, and the catches 84 of the straps 82 are wedged into the lower strap slots 48 to hold each of the elongated sections 64 together, as best shown in FIG. 7. The straps 82 also extend across the fin space 68 between and over the upper side edges 24 of the spaced fin walls 22 and the catches thereof are wedged into the upper strap slots 56. A second adhesive 86 is disposed over the strap slots 48, 56 of the elongated sections 64, as shown in FIG. 7, before extending the straps 82 across the fin space 68 and wedging the catches 84 into the strap slots 48, 56 to adhere the straps 82 to each of the elongated sections 64. However, the straps 82 can extend across the fin space 68 and hold the elongated sections 64 together without the second adhesive 86. Each light emitting assembly typically includes three straps 82 wedged into the upper strap slots 56 and three straps 82 wedged into the lower strap slots 48 of each elongated section 64, as shown in FIGS. 1 and 5. Alternatively, the light emitting assembly can include more straps 82, fewer straps 82, or no straps 82 to be held together by the second adhesive 86. The elongated sections 64, fins 70, and straps 82 are brazed together to secure them in the position described above. However, other methods, such as bolts or pins, can be used to secure the assembly in position.

A plurality of light emitting diodes 88 are disposed on the heat sink 20, and typically on the mounting surface 42 of each elongated section 64, as shown in FIG. 1. The light emitting diodes 88 can be disposed on the mounting surface 42 before or after cutting the extruded strip of heat sink 20 into the at least two elongated sections 64. Heat generated by the light emitting diodes 88 travels from the LED wall 40 through the truss members 46, 50 and heat transfer web 58 to the fin wall 22 and fins 70. The light assembly provides a short thermal path from the light emitting diodes 88 to the fins 70. As alluded to above, ambient air is able to flow through the air paths between the fins 70 so that the fins 70 effectively shed heat to the ambient air, thus minimizing the temperature rise at the light emitting diodes 88.

Figure 3:
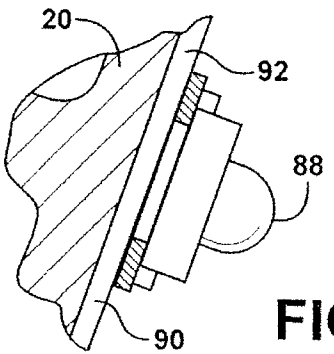
FIG. 3 is an enlarged fragmentary cross sectional view showing one light emitting diode and accompanying electrical components on the heat sink of FIG. 1.

Before disposing the light emitting diodes 88 on the heat sink 20, a coating 90 of electrically insulating material is disposed over the mounting surface 42 of each elongated section 64. A plurality of circuit traces 92 are also disposed on the coating 90, as shown in FIGS. 2 and 3. The circuit traces 92 are spaced from one another on the coating 90 by the light emitting diodes 88. One of the light emitting diodes 88 is disposed in each of the spaces between adjacent circuit traces 92. The light emitting diodes 88 on each elongated section 64 are connected in series with one another, and the light emitting diodes 88 on each elongated section 64 are connected in parallel with the light emitting diodes 88 on the paired elongated section 64.

A plurality of reflectors 94 are disposed on each of the mounting surfaces 42 adjacent the light emitting diodes 88 so that each reflector 94 is disposed over one of the of the light emitting diodes 88, as shown in FIGS. 1 and 2. The reflectors 94 are typically formed of a coated plastic material and designed to direct light from the light emitting diode 88 in a predetermined direction. Each of the reflectors 94 extends upwardly at a predetermined angle from the mounting surface 42 over the light emitting diode 88 to direct the light in the predetermined direction. The reflectors 94 can be disposed on the mounting surface 42 before or after cutting the extruded strip of heat sink 20 into the elongated sections 64.

A protective cover 96 is also disposed on the mounting surface 42 over the light emitting diodes 88 and over the reflectors 94 of each elongated section 64 to protect the light emitting diodes 88 and the reflectors 94, as shown in FIGS. 1 and 2. The protective cover 96 extends along the mounting surface 42 between open cover ends adjacent the upper side edge 24 of the LED wall 40. The protective cover 96 extends over the reflectors 94 and the light emitting diodes 88 to a distal cover end 98 aligned with the lower side edge 26. A cover end panel 100 extends between the protective cover 96 and the mounting surface 42 of the LED wall 40 at each of the open cover ends. The protective covers 96 and the cover end panels 100 are typically formed of an opaque plastic material. The protective cover 96 is disposed on the mounting surface 42 after cutting the heat sink 20 into the elongated sections 64 and disposing the light emitting diodes 88 and reflectors 94 on the elongated sections 64.

A lens 102 is disposed over the light emitting diodes 88 and reflectors 94 on each elongated sections 64, as shown in FIGS. 1 and 2, to further protect the light emitting diodes 88 and the reflectors 94. The lens 102 covers and is spaced from the light emitting diodes 88 and the reflectors 94. The lens 102 extends between the bottom side edge 34 of the LED wall 40 to the distal cover end 98 to close the protective cover 96. The lens 102 is formed of a transparent or translucent material. The lens 102 is disposed on the mounting surface 42 after cutting heat sink 20 into the elongated sections 64 and after disposing the light emitting diodes 88, reflectors 94, and protective cover 96 on the elongated sections 64.

Obviously, many modifications and variations of the present invention are possible in light of the above teachings and may be practiced otherwise than as specifically described while within the scope of the appended claims. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. An L.E.D. light emitting assembly comprising:

a heat sink (20), a plurality of light emitting diodes (88) disposed on said heat sink (20), said heat sink (20) including a pair of elongated sections (64) spaced and parallel to one another to define a fin space (68) therebetween, a plurality of fins (70) disposed in spaced relationship to one another and extending in width across said fin space (68) between said elongated sections (64), and characterized by each of said fins (70) including at least one bend (72) rendering said fins (70) compressible in said width across said fin space (68) for being spring compressed between said elongated sections (64) at least one connector (82) extending across said fin space (68) between said elongated sections (64) to clamp said fins (70) between said elongated sections (64).

2. An assembly as set forth in claim 1 wherein at least one of said elongated sections (64) includes a pair of fin retaining ridges (28) presenting a fin channel (38) therebetween to retain said fins (70) in said fin channel (38).

3. An assembly as set forth in claim 1 wherein said fins (70) extend between fin ends and include a shoe (76) at each of said fin ends in abutting relationship with an adjacent fin (70) to space said fins (70) from one another in said fin space (68) to define an air path therebetween for heat transfer with said fins (70).

4. An assembly as set forth in claim 3 wherein each of said shoes (76) is L-shaped in cross section to present an inwardly extending flange (78) engaging said adjacent fin (70).

5. An assembly as set forth in claim 1 wherein at least one of said elongated sections (64) presents a fin wall (22) engaging said plurality of fins (70) and an LED wall (40) supporting said light emitting diodes (88) and spaced from said fin wall (22) and a heat transfer web (58) connecting said fin wall (22) to said LED wall (40) for transferring heat from said LED wall (40) to said fin wall (22).

6. An assembly as set forth in claim 1 wherein at least one of said elongated sections (64) presents a fin wall (22) engaging said plurality of fins (70) and having an upper side edge (24) and a lower side edge (26) and an LED wall (40) extending upwardly and outwardly from a bottom side edge (34) adjacent said lower side edge (26) of said fin wall (22) to a top side edge (36) spaced from said upper side edge (24) of said fin wall (22) so that said LED wall (40) is canted relative to said fin wall (22).

7. An assembly as set forth in claim 6 wherein said connector includes including a plurality of straps (82) having a catch (84) at each end thereof and extending across said fin space (68) between said elongated sections (64) to clamp said fins (70) between said elongated sections (64) and said bottom side edge (34) of said LED wall (40) being spaced from said lower side edge (26) of said fin wall (22) and a lower truss member (46) connecting said fin wall (22) to said LED wall (40) adjacent said lower side edge (26) to define a lower strap slot (48) between said fin wall (22) and said LED wall (40) for engagement with said catches (84) of said straps (82).

8. An assembly as set forth in claim 6 wherein said connector includes a plurality of straps (82) having a catch (84) at each end thereof and extending across said fin space (68) between said elongated sections (64) to clamp said fins (70) between said elongated sections (64) and an upper truss member (50) connecting said fin wall (22) to said LED wall (40) adjacent said upper side edge (24) to define an upper strap slot (56) between said fin wall (22) and said LED wall (40) for engagement with said catches (84) of said straps (82).

9. An assembly as set forth in claim 8 including an attachment block (52) extending along said upper truss member (50) and spaced from said upper side edge (24) of said fin wall (22) to further define said upper strap slot (56) between said fin wall (22) and said attachment block (52) for engagement with said catches (84) of said straps (82).

10. An assembly as set forth in claim 6 including a lower truss member (46) connecting said fin wall (22) to said LED wall (40) adjacent said lower side edge (26) and an upper truss member (50) connecting said fin wall (22) to said LED wall (40) adjacent said upper side edge (24) and a heat transfer web (58) connecting said fin wall (22) to said LED wall (40) in the space between said truss members (46, 50) for transferring heat from said LED wall (40) to said fin wall (22).

11. An assembly as set forth in claim 10 wherein said heat transfer web (58) defines an upper tubular space (62) between said heat transfer web (58) and said upper truss member (50) and a lower tubular space (60) between said heat transfer web (58) and said lower tubular space (60) having a smaller cross sectional area than a cross sectional area of said upper tubular space (62).

12. An assembly as set forth in claim 6 wherein said LED wall (40) presents a heat transfer surface (44) facing inwardly toward said fin wall (22) and a mounting surface (42) facing outwardly and including a plurality of circuit traces (92) spaced from one another on said mounting surface (42) and said light emitting diodes (88) being disposed in the spaces (60, 62, 68) between adjacent circuit traces (92).

13. An L.E.D. light emitting assembly comprising:

an elongated heat sink (20) of thermally conductive aluminum material, a plurality of light emitting diodes (88) disposed on said elongated heat sink (20), said heat sink (20) including a pair of elongated sections (64) being mirror images of one another in cross section and presenting fin walls (22) spaced and parallel to one another to define a fin space (68) therebetween with each fin wall (22) having an upper side edge (24) and a lower side edge (26), a plurality of fins (70) disposed in parallel and spaced relationship to one another and extending in width across said fin space (68) between said fin walls (22) of said elongated sections (64), a fin retaining ridge (28) extending transversely from and continuously along each of said side edges (24, 26) of said fin walls (22) to present a fin channel (38) having a channel height ($h_c$) between said fin retaining ridges (28), each of said fins (70) extending between fin ends and having a fin height ($h_f$) being slightly less than said channel height ($h_c$), each of said fins (70) having a shoe (76) L-shaped in cross section at each of said fin ends extending transversely from each of said fins (70) and slidably disposed in said fin channels (38) between said retaining ridges (28) of said adjacent elongated sections (64) and presenting an inwardly extending flange (78) in abutting relationship with an adjacent fin (70) to space said fins (70) from one another in said fin space (68) to define an air path therebetween for heat transfer with said fins (70), each of said fins (70) having a plurality of bends (72) extending along said fin height ($h_f$) and disposed between said fin ends rendering said fins (70) compressible in said width between said fin ends across said fin space (68) for being spring compressed between said fin walls (22), each of said fins (70) including a shoe engagement section (66) at each fin end (74) for parallel engagement with said flanges (78) of the adjacent one of said fins (70), a plurality of straps (82) extending across said fin space (68) between and over said upper side edges (24) of said spaced fin walls (22) and between and over said lower side edges (26) of said spaced fin walls (22) of said elongated sections (64) to clamp said shoes (76) of said fins (70) between said fin walls (22) of said elongated sections (64), said straps (82) having a catch (84) at each end thereof, a first adhesive (80) securing said shoes (76) of said fins (70) to said fin walls (22) of said elongated sections (64), a second adhesive (86) securing said straps (82) to said elongated sections (64), each of said elongated sections (64) presenting an LED wall (40) spaced from said fin wall (22) and extending upwardly and outwardly from a bottom side edge (34) spaced from said lower side edge (26) of said fin wall (22) to a top side edge (36) spaced a greater distance from said upper side edge (24) than said lower side edge (26) so that said LED walls (40) of said heat sink (20) are canted relative to one another and face away from one another, each of said LED walls (40) presenting a mounting surface (42) facing outwardly and a heat transfer surface (44) facing inwardly toward said fin wall (22), a lower truss member (46) connecting said fin wall (22) to said heat transfer surface (44) adjacent said lower side edge (26) to space said heat transfer surface (44) from said fin wall (22) and to define a lower strap slot (48) for wedged engagement with said catches (84) of said straps (82) between said fin wall (22) and said heat transfer surface (44), an upper truss member (50) connecting said fin wall (22) below said upper side edge (24) to said heat transfer surface (44) to space said heat transfer surface (44) further from said fin wall (22) than by said lower truss member (46), an attachment block (52) extending along said upper truss member (50) and spaced from said upper side edge (24) of said fin wall (22) to define an upper strap slot (56) for wedged engagement with said catches (84) of said straps (82) between said fin wall (22) and said attachment block (52), said attachment block (52) defining a C-shaped attachment slot (54) extending into and continuously along said attachment block (52) for mounting said assembly, a heat transfer web (58) connecting said fin wall (22) to said heat transfer surface (44) in the space between said truss members (46, 50) for transferring heat from said heat transfer surface (44) to said fin wall (22), said heat transfer web (58) extending continuously along said walls (22, 40) to define a upper tubular space (62) between said heat transfer web (58) and said upper truss member (50) and a lower tubular space (60) between said heat transfer web (58) and said lower truss member (46), and said upper tubular space (62) having a greater cross sectional area than a cross sectional area of said lower tubular space (60).

14. An assembly as set forth in claim 13 including:

a coating (90) of electrically insulating material disposed over said mounting surface (42) of each elongated section (64), a plurality of circuit traces (92) spaced from one another on said coating (90) for preventing electrical conduction between said circuit traces (92) so that said coating (90) prevents electrical conduction from each of said circuit traces (92) to said heat sink (20), said plurality of light emitting diodes (88) being disposed in each of the spaces between adjacent circuit traces (92), said light emitting diodes (88) on each of said elongated sections (64) being electrically connected in series with one another, said light emitting diodes (88) on each of said elongated sections (64) being electrically connected in parallel with said light emitting diodes (88) on the paired elongated section (64), a plurality of reflectors (94) disposed on each of said mounting surfaces (42) adjacent said light emitting diodes (88) for directing light from said light emitting diode (88) in a predetermined direction, each of said reflectors (94) disposed over one of said light emitting diodes (88) and extending upwardly at a predetermined angle from said mounting surface (42) over said light emitting diode (88) for directing the light in said predetermined direction, a protective cover (96) disposed on and extending along each of said mounting surfaces (42) between open cover ends adjacent said upper side edge (24) and extending over said reflectors (94) and said light emitting diodes (88) to a distal cover end (98) aligned with said lower side edge (26) for protecting said reflectors (94) and said light emitting diodes (88), a cover end panel (100) extending between said protective cover (96) and said mounting surface (42) of said LED wall (40) at each of said open cover ends for closing said protective covers (96), and a lens (102) covering and spaced from said light emitting diodes (88) and said reflectors (94) and extending from said lower side edge (26) to said distal cover end (98) of said protective cover (96) for protecting said light emitting diodes (88).

15. A method of fabricating an L.E.D. light emitting assembly comprising the steps of:

forming a strip of heat sink (20), dividing the strip of heat sink (20) into at least two elongated sections (64), disposing a plurality of light emitting diodes (88) on the heat sink (20), spacing each elongated section (64) from and parallel to another one of the elongated sections (64) to define a fin space (68) therebetween, disposing a plurality of fins (70) in spaced relationship to one another and extending in width across the fin space (68) between the elongated sections (64), and characterized by forming at least one bend (72) in each of the fins (70) to render the fins (70) compressible in the width across the fin space (68) extending at least one connector (82) across the fin space (68) to hold the pair of elongated sections (64) together with the fins (70) clamped therebetween.

16. A method as set forth in claim 15 including moving the pair of elongated sections (64) toward one another to a predetermined dimension of the fin space (68) to spring compress each of the fins (70) between the pair of elongated sections (64).

17. A method as set forth in claim 16 including forming the plurality of fins (70) extending between fin ends and forming a shoe (76) at each of the fin ends and wherein said disposing the plurality of fins (70) across the fin space (68) includes engaging the shoes (76) with the elongated sections (64).

18. A method as set forth in claim 17 wherein said disposing the plurality of fins (70) across the fin space (68) includes engaging the shoes (76) of the fins (70) with an adjacent fin (70) to space the fins (70) along the elongated sections (64).

19. A method as set forth in claim 18 wherein said forming the shoes (76) includes forming a flange (78) in each of the shoes (76) extending inwardly toward one another so that each of the shoes (76) presents an L-shaped cross section and wherein said engaging the shoes (76) with an adjacent fin (70) includes engaging the flanges (78) of the shoes (76) with the adjacent fin (70).

20. A method as set forth in claim 16 wherein said forming the strip of heat sink (20) includes extruding a continuous strip of an elongated heat sink (20) having a cross section presenting a fin wall (22) having an upper side edge (24) and a lower side edge (26) and presenting an LED wall (40) spaced from the fin wall (22) and extending upwardly and outwardly from a bottom side edge (34) spaced from the lower side edge (26) of the fin wall (22) to a top side edge (36) spaced a greater distance from the upper side edge (24) than the lower side edge (26) and a presenting a lower truss member (46) connecting the fin wall (22) to the LED wall (40) above the lower side edge (26) to space the LED wall (40) from the fin wall (22) and to define a lower strap slot (48) and presenting an upper truss member (50) connecting the fin wall (22) below the upper side edge (24) to the LED wall (40) to space the LED wall (40) further from the fin wall (22) than by the lower truss member (46) to define an upper strap slot (56) between the fin wall (22) and the LED wall (40).

21. A method as set forth in claim 20 including forming the plurality of straps (82) having catches (84) at the ends (74, 98) thereof and wherein said extending the straps (82) across the fin space (68) includes wedging the catches (84) into the strap slots (48, 56) to hold the pair of elongated sections (64) together with the fins (70) clamped therebetween.

22. A method as set forth in claim 15 wherein said forming the strip of heat sink (20) includes forming an elongated heat sick having a cross section presenting a fin wall (22) and an LED wall (40) spaced from the fin wall (22) and a heat transfer web (58) connecting the fin wall (22) to the LED wall (40).

23. A method as set forth in claim 15 wherein said forming the strip of heat sink (20) includes extruding a continuous strip of an elongated heat sink (20) of thermally conductive aluminum material having a cross section presenting a fin wall (22) having an upper side edge (24) and a lower side edge (26) and a fin retaining ridge (28) extending transversely from each of the side edges (24, 26) to present a fin channel (38) having a channel height ($h_c$) therebetween and presenting an LED wall (40) spaced from the fin wall (22) and extending upwardly and outwardly from a bottom side edge (34) spaced from the lower side edge (26) of the fin wall (22) to a top side edge (36) spaced a greater distance from the upper side edge (24) than the lower side edge (26) and a mounting surface (42) facing outwardly and a heat transfer surface (44) facing toward the fin wall (22) and a presenting a lower truss member (46) connecting the fin wall (22) to the heat transfer surface (44) of the LED wall (40) above the lower side edge (26) to space the heat transfer surface (44) from the fin wall (22) and to define a lower strap slot (48) and presenting an upper truss member (50) connecting the fin wall (22) below the upper side edge (24) to the heat transfer surface (44) to space the heat transfer surface (44) further from the fin wall (22) than by the lower truss member (46) and presenting an attachment block (52) extending along the upper truss member (50) and spaced from the upper side edge (24) of the fin wall (22) to define an upper strap slot (56) and presenting a heat transfer web (58) connecting the fin wall (22) and the heat transfer surface (44) in the space between the truss members (46, 50) to define a lower tubular space (60) between the heat transfer web (58) and the lower truss member (46) and an upper tubular space (62) between the heat transfer web (58) and the upper truss member (50) having a greater cross sectional area than a cross sectional area of the lower tubular space (60).

24. A method of fabricating an L.E.D. light emitting assembly comprising:

extruding a continuous strip of an elongated heat sink (20) of thermally conductive aluminum material having a cross section presenting a fin wall (22) having an upper side edge (24) and a lower side edge (26) and a fin retaining ridge (28) extending transversely from each of the side edges (24, 26) to present a fin channel (38) having a channel height ($h_c$) therebetween and presenting an LED wall (40) spaced from the fin wall (22) and extending upwardly and outwardly from a bottom side edge (34) spaced from the lower side edge (26) of the fin wall (22) to a top side edge (36) spaced a greater distance from the upper side edge (24) than the lower side edge (26) and a mounting surface (42) facing outwardly and a heat transfer surface (44) facing toward the fin wall (22) and a presenting a lower truss member (46) connecting the fin wall (22) to the heat transfer surface (44) of the LED wall (40) above the lower side edge (26) to space the heat transfer surface (44) from the fin wall (22) and to define a lower strap slot (48) and presenting an upper truss member (50) connecting the fin wall (22) to the heat transfer surface (44) below the upper side edge (24) to space the heat transfer surface (44) further from the fin wall (22) than by the lower truss member (46) and presenting an attachment block (52) extending along the upper truss member (50) and spaced from the upper side edge (24) of the fin wall (22) to define an upper strap slot (56) and presenting a heat transfer web (58) connecting the fin wall (22) and the heat transfer surface (44) in the space between the truss members (46, 50) to define a lower tubular space (60) between the heat transfer web (58) and the lower truss member (46) and an upper tubular space (62) between the heat transfer web (58) and the upper truss member (50) having a greater cross sectional area than a cross sectional area of the lower tubular space (60), cutting the continuous strip of heat sink (20) into at least two independent elongated sections (64), disposing a first adhesive (80) over the fin walls (22) of the elongated sections (64), disposing a second adhesive (86) over the strap slots (48, 56) of the elongated sections (64), disposing the fin wall (22) of each elongated section (64) facing and parallel to the fin wall (22) of the other one of the elongated sections (64) so that each pair of elongated sections (64) mirror one another, spacing the fin walls (22) of each pair of elongated sections (64) from one another to define a fin space (68) therebetween, forming a continuous sheet of aluminum material, stamping the continuous sheet of aluminum material to form a plurality of bends (72) therein, cutting the continuous sheet of aluminum material into a plurality of sheet strips each having a fin height ($h_f$) being slightly less than the channel height ($h_c$) and each having the plurality of spaced bends (72) extending along the fin height ($h_f$), cutting each of the sheet strips into a plurality of fins (70) extending between fin ends and each having the fin height ($h_f$) and including at least one of the bends (72) extending along the fin height ($h_f$), forming a shoe (76) at each of the fin ends, forming a flange (78) in each of the shoes (76) to extend inwardly toward one another so that each of the shoes (76) presents an L-shaped cross section, disposing the shoes (76) of a plurality of the fins (70) along the fin channels (38) between the fin retaining ridges (28) of the pair of elongated sections (64), engaging the inwardly extending flanges (78) with the adjacent fins (70) to space the fins (70) along the fin channels (38), moving the pair of elongated sections (64) toward one another to compress each of the fins (70) between the fin channels (38) of the fin walls (22) of the pair of elongated sections (64), forming a plurality of straps (82) having U-shaped catches (84) at the ends (74, 98) thereof, extending a plurality of the straps (82) across the fin space (68) and wedging the catches (84) thereof into the upper strap slots (56) to hold each pair of elongated sections (64) together with said fins (70) clamped therebetween, extending the plurality of straps (82) across the fin space (68) and wedging the catches (84) thereof into the lower strap slots (48) to hold each pair of elongated sections (64) together with said fins (70) clamped therebetween, and brazing each of the elongated sections (64) and fins (70) and straps (82) together.

25. A method as set forth in claim 24 further comprising:

disposing a coating (90) of electrically insulating material over the mounting surface (42) of each elongated section (64), disposing a plurality of circuit traces (92) spaced from one another on the coating (90), disposing one of the light emitting diodes (88) in each of the spaces between adjacent circuit traces (92), electrically connecting the light emitting diodes (88) on each elongated section (64) in series with one another, electrically connecting the light emitting diodes (88) each elongated section (64) in parallel with the light emitting diodes (88) on the paired elongated section (64), disposing a plurality of reflectors (94) on each of the mounting surfaces (42) adjacent the light emitting diodes (88) so that each reflector (94) is disposed over one of the light emitting diodes (88), disposing a protective cover (96) on each of the mounting surfaces (42) adjacent the upper side edge (24) and over the light emitting diodes (88) and the reflectors (94) of each elongated section (64), extending a cover end panel (100) between the protective cover (96) and the mounting surface (42) at open ends of the protective cover (96), and extending a lens (102) over the light emitting diodes (88) and the reflectors (94) of each elongated section (64).

* * * * *

UNITED STATES PATENT AND TRADEMARK OFFICE

CERTIFICATE OF CORRECTION

PATENT NO. : 8,591,071 B2
APPLICATION NO. : 13/389497
DATED : November 26, 2013
INVENTOR(S) : Hochstein It is certified that error appears in the above-identified patent and that said Letters Patent is hereby corrected as shown below:

In the Claims

| Column | Line | |
|---|---|---|
| 6 | 36 | "sections (64) at least" should read "sections (64), at least" |
| 7 | 2 | "includes including" should read "includes" |
| 10 | 53 | "forming the plurality of straps" should read "forming the connector with the plurality of straps" |

Signed and Sealed this
Twenty-seventh Day of May, 2014

Michelle K. Lee

Michelle K. Lee
*Deputy Director of the United States Patent and Trademark Office*